United States Patent [19]

Paliwal

[11] Patent Number: 4,690,796

[45] Date of Patent: Sep. 1, 1987

[54] PROCESS FOR PRODUCING ALUMINUM-TITANIUM DIBORIDE COMPOSITES

[75] Inventor: Muktesh Paliwal, Sayre, Pa.

[73] Assignee: GTE Products Corporation, Stamford, Conn.

[21] Appl. No.: 839,313

[22] Filed: Mar. 13, 1986

[51] Int. Cl.[4] ..... B22F 1/00

[52] U.S. Cl. ..... 419/12; 419/23; 419/32; 419/34; 75/0.5 BC; 75/244; 264/7; 427/217

[58] Field of Search ..... 419/12, 32, 34, 23; 75/0.5 BC, 244; 264/7; 427/217

[56] References Cited

U.S. PATENT DOCUMENTS

| | | | |
|---|---|---|---|
| 3,655,425 | 4/1972 | Longo et al. | 75/244 X |
| 3,881,991 | 5/1975 | Cheney et al. | 75/0.5 BC X |
| 3,960,545 | 6/1976 | Port et al. | 75/0.5 BC X |
| 4,447,501 | 5/1984 | Shigeru et al. | 75/0.5 BC X |
| 4,585,618 | 4/1986 | Fresnel et al. | 419/12 |
| 4,594,101 | 6/1986 | Miura et al. | 75/0.5 BC X |

*Primary Examiner*—Stephen J. Lechert, Jr.
*Assistant Examiner*—Susan Wolffe
*Attorney, Agent, or Firm*—Donald R. Castle; L. Rita Quatrini

[57] ABSTRACT

A process is disclosed for producing composite powder particles consisting essentially of a matrix phase and a reinforcement phase. The process involves entraining agglomerated particles in a carrier gas, the agglomerated particles consisting essentially of titanium diboride and particles of a metal selected from the group consisting of aluminum and aluminum based alloys. The agglomerated particles are fed through a high temperature zone having a temperature sufficient to allow the metal particles to melt, coalesce together, and encapsulate the titanium diboride particles. The metal is then resolidified, resulting in the formation of the composite powder particles wherein the matrix phase consists essentially of the metal and the reinforcement phase consists essentially of the titanium diboride particles.

A process is disclosed for producing a composite material in which the metal which is selected from the group consisting of aluminum and aluminum based alloys is the matrix phase and titanium diboride is the reinforcement phase. The process involves entraining agglomerates in a carrier gas and passing the agglomerates through a high temperature zone as described above. The metal is resolidified by impacting the resulting high temperature treated particles against a surface having a temperature below the solidification temperature of the metal.

8 Claims, 4 Drawing Figures

PROCESS FOR PRODUCING ALUMINUM-TITANIUM DIBORIDE COMPOSITES

This work was done under a government contract with DARPA. The government has certain rights as specified in Contract No. F33615-84-C-5063.

BACKGROUND OF THE INVENTION

This invntion relates to a process for producing a composite consisting essentially of a titanium diboride reinforcement phase dispersed in a metal matrix which can be aluminum metal or an aluminum based alloy.

Aluminum based alloys are relatively light weight and low cost materials and thus desirable for use in aerospace applications. Their use however, have been limited to low temperature applications because of rapid degradation of their mechanical properties at temperatures above about 250° F. Development of aluminum alloys with adequate mechanical properties at higher temperatures would be highly desirable since these could be used to replace more expensive titanium based alloys.

At present, development of these high temperature aluminum alloys is based on two key concepts or technologies, that is, (1) rapidly solidified alloys and (2) metal-matrix composites. The rapid solidification method is based on the principle that rapid cooling during the solidification process results in refined microstructures and/or super saturation of the metal matrix with alloying elements resulting in increased precipitation hardening upon using suitable heat treatment. Atomization and melt spinning are two of the techniques used to achieve the high cooling rates. Alloying elements used to impart the desirable high temperature properties have low solubility and diffusivities in the metal matrix and precipitate out as intermetallic compounds. Alloys being developed are based on the systems. Al-Fe-Ce Al-Fe-Mo, Al-Ti-Hf, Al-Cr-Zr, etc. The high temperature emchanical properties of these rapidly solidified alloys is dependent on the thermal stability of the precipitated phases. Though the improvements in the high temperature mechanical properties of these advanced powder metallurgy aluminum base alloys have been impressive, they lack specific strength equivalency with titanium based alloys.

The second methof of producing a high temperature high strength aluminum based system is based on the composite approach. For example, discontinuously reinforced aluminum alloys fabricated via powder metallurgy processing represent a maturing technology offering aluminum based alloys having improved specific stiffness and strength at only a slight increase in density. Silicon carbide whisker or particulate-reinforced aluminum alloys are fabricated using the composite approach. The process for fabricating whisker reinforced materials on a commercial basis has been developed by ARCO Metal's Silag Operation. U.S. Pat. No. 4,259,112 assigned to DWA Composite Specialities, Inc. describes a method in which a binder is utilized to make green "pancakes" of SiC and aluminum powders which are then stacked prior to hot pressing. While the preliminary steps to fabricate a billet are somewhat different, both ARCO and DWA processes involve vacuum hot pressing slightly above the solidus temperature to achieve full densification of billet and plate. Subsequent extrusion or forging of the billet is necessary to optimize mechanical properties.

The apparent need to hot press at a temperature above the solidus temperature of the alloy, (that is, the alloy is partially remelted) to achieve wetting of the silicon carbide reinforcement is a limitation of the process since the solidification rate experienced by the remelted matrix is comparatively much slower than that of the starting powder material used as the metal matrix. Thus, the melting and resolidification cycle used in the process destroys the desirable rapidly solidified structure of the starting powder. The resulting alloy segregation can be deleterious in terms of the mechanical properties of the matrix and hence of the composite system.

Another composite technique called "compocasting" invovles adding non-metals to partially solidified alloys. The high viscosity of the metal slurry prevents particles from settling, floating, or agglomerating. Bonding of non-metal to metal is accomplished by interaction between the respective particles. Mehrabian, R., Riek, R.G., and Flemings, M.C., "Preparation and Casting of Metal-Particulate Non-Metal Composities," Metall. Trans., 5(1974) 1899–1905 and Mehrabian, R., Sato, A., and Flemings, M.C., "Cast Composites of Aluminum Alloys," Light Metals, 2(1975) 177–193. The cooling rates experienced by the metal-matrix are again low, comparable to other casting techniques ($10^{-3}$ to 1° C./sec.). Still another method for producing powder metallurgy composite materials is by mechanical alloying. This is essentially a high energy ball milling operation which is done typically in a stirred ball mill called an attritor mill. High strength material results from mechanically working the alloy because of incorporation of oxides and carbides during the milling operation, and because of strengthening mechanisms due to severe working resulting in fine grain and sub fine grain size.

SUMMARY OF THE INVENTION

In acceptance with one aspect of the invention there is provided a process for producing composite powder particles consisting essentially of a matrix phase and a reinforcement phase. The process involves entraining agglomerated particles in a carrier gas, the agglomerated particles consisting essentially of titanium diboride and particles of a metal selected from the group consisting of aluminum and aluminum based alloys. The agglomerated particles are fed through a high temperature zone having a temperature sufficient to allow the metal particles to melt, coalesce together, and encapsulate the titanum diboride particles. The metal is then resolidified, resulting in the formation of the composite powder particles wherein the matrix phase consists essentially of the metal and the reinforcement phase consists essentially of the titanium diboride particles.

In accordance with another aspect of this invention, a composite material is formed in which the metal which is selected from the group consisting of aluminum and aluminum-based alloys is the matrix phase and titanium diboride is the reinforcement phase. The process involves entraining agglomerates in a carrier gas and passing the agglomerates through a high temperature zone as described above. The metal is resolidified by impacting the resulting high temperature treated particles against a surface having a temperature below the solidification temperature of the metal.

DETAILED DESCRIPTION OF THE INVENTION

Figure 1:
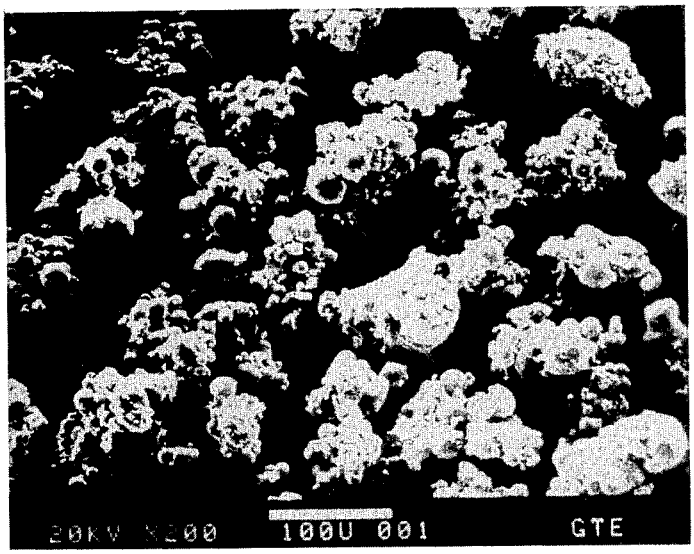
FIG. 1 is a SEM photograph of agglomerates made from aluminum and titanium diboride.

For a better understanding of the present invention, together with other and further objects, advantages, and capabilities thereof reference is made to the following disclosure and appended claims in connection with the above described figures and description of some of the aspects of the invention.

The starting materials are agglomerated particles consisting essentially of titanium diboride and metal particles which are either aluminum metal or an aluminum based alloy. The term "metal" as used in this invention means aluminum or aluminum based alloys.

The agglomeration is done by standard techniques, such as by spray drying or air drying a slurry of a binder and titanium diboride and aluminum or aluminum based alloy particles.

In accordance with a preferred embodiment of this invention, the agglomerated particles are dewaxed by standard methods to remove the binder if deemed necessary before further processing.

The agglomerates are sintered by standard methods to impart sufficient strength to the particles for subsequent operations.

It is preferred that the aggomerated particles be classified to obtain the desired particle size ranges.

The agglomerated particles are entrained in a carrier gas which is preferably argon.

The agglomerated particles entrained in the carrier gas are then fed through a high temperature zone having a temperature sufficient to allow the metal particles to melt, coalesce together, and encapsulate the titanium diboride particles.

The source for the high temperature zone can be a plasma such as a DC or RF, or a flame spray gun. The preferred high temperature source is a DC plasma gun.

In accordance with a preferred embodiment, the agglomerates are injected into the hot plasma jet using the carrier gas. The metal particles metl, and coalesce together encapsulating the titanium diboride.

The metal is then resolidified to form composite particles having a matrix phase of the aluminum or aluminum based alloy and a reinforcement phase of titanium diboride particles.

In accordance with the preferred embodiment, the resolidification is done by allowing the resultant high temperature treated particles to travel out of the high temperature zone to a cooler zone having a temperature below the solidification temperature of the metal to allow the metal to resolidify. The resulting composite particles are spherical in shape. The reinforcement phase is well dispersed in and bonded to the metal matrix. The metal matrix exhibits a microstructure similar to rapidly solidified gas atomized powders at cooling rates of from about $10^2$ to about $10^{5°}$ C./sec. The typcical particle size of the resulting composite particles is from about 25 to about 200 mcirons in diameter. The typical particle size of the reinforcement phase particles is less than about 20 and preferably less than about 10 microns in diameter.

In accordance with another aspect of this invention, the resulting high temperature treated particles are resolidified by impacting the resulting high temperature treated particles onto a solid substrate or into a liquid medium wherein the resolidification of the metal matrix takes place after the impact. In the case of impact with a solid substrate, a deposit or coating of the composite material forms on the substrate.

Details of the principles and operation of plasma reactors are well known.

A typical plasma gun incorporates a conical thoriated tungsten cathode, a water-cooled annular copper anode which also serves as a nozzle, a gas injection system and a powder injection system. Gases used are selected for inertness and/or energy content. These gases include but are not limited to argon, hydrogen, helium, and nitrogen. Plasma gun operating power levels are generally in the 15 to 80 KW range. The location of the power injection port varies with the nozzle design and/or the powder material. It is either in the nozzle (anode) throat or downstream of the nozzle exit.

The plasma jet is not a uniform heat source. It exhibits steep temperature (enthalpy) and velocity gradients which determine the velocity and temperature achieved by the injected powder particles (agglomerates). In addition, the particle trajectories (and hence the temperature and velocity) are affected by the particle size, shape, and thermophysical properties. The particle temperature is controlled by appropriately selecting the plasma operating conditions (plasma gas composition and flow rate and plasma gun power) and the injection parameters (injection port location and carrier gas flow rate.

U.S. Pat. Nos. 3,909,241 and 3,974,245 relate to processes for producing free flowing powders by agglomerating finely divided material, classifying the agglomerates to obtain a desired size range, entraining the agglomerates in a carrier gas, feeding the agglomerates through a high temperature plasma reactor to cause at least partial melting of the particles, and collecting the particles in a cooling chamber containing a protective gaseous atmosphere, wherein particles are solidified.

The composite made by the process of this invention can be consolidated to net shape using conventional powder metallurgy technique, for example, pressing and sintering, isostatic pressing, forging, extrusion, and combinations thereof.

The consolidation step can be carried out at temperatures below the solidus or solidification temperature of the aluminum or aluminum based alloy sine the reinforcement phase is already bonded to the matrix. Thus unlike the composite approaches discussed previously the metal matrix does not need to be remelted during the consolidation process.

To more fully illustrate this invention, the following nonlimiting example are presented.

EXAMPLE 1

Figure 2:
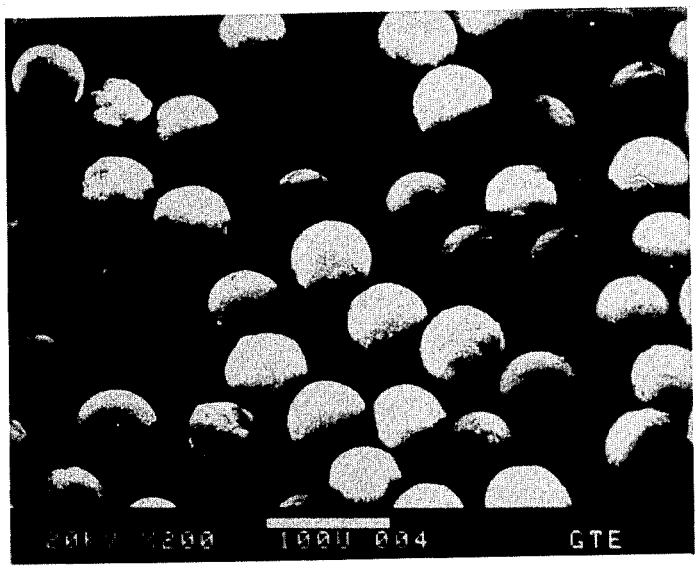
FIG. 2 is an SEM photograph of the plasma melted aluminum-titanium diboride composite of this invention.
Figure 3:
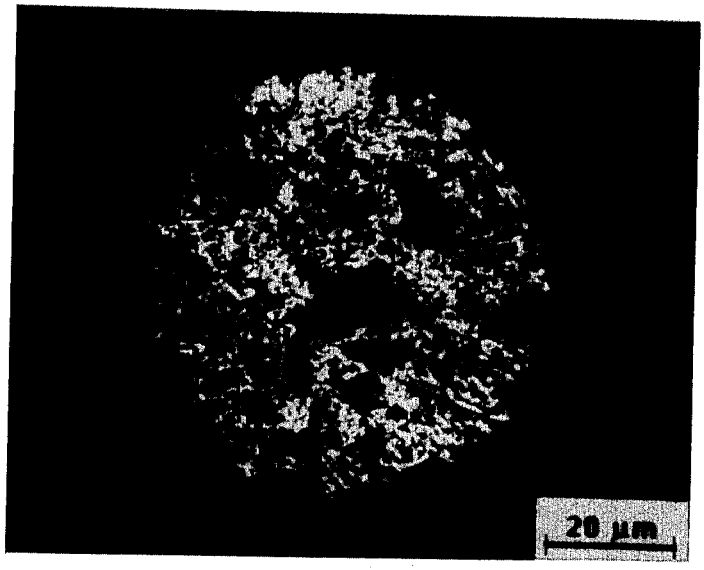
FIG. 3 is an cross section micrograph of the plasma melted aluminum-titanium diboride composite of this invention.

Agglomerates consisting essentially of about 20% by weight titanium diboride having an average diameter of about 6 microns and the balance an aluminum based alloy 2124A1 having an average diameter of bout 13 microns are made by air drying in a tray a slurry of the titanium diboride, the aluminum alloy, polyvinyl butyral as a binder supplied by Monsanto under the trade name of Butvar B-76, and ethyl alcohol as the liquid slurry medium. The binder content is about 2% by weight of the total powder charge. Particle size analysis of the dried agglomerates indicates a mean particle size of about 86 microns. The agglomerates are subsequently dewaxed and sintered in a hydrogen furnace. The dewaxing temperature and time are about 400° C. and about 2 hours respectively. Sintering is carried out at about 600° C. for about 4 hours. The agglomerates are then cooled slowly to room temperature. The dewaxed and sintered agglomerates are then screened into different size ranges. Agglomerates in the size range of from about 75 to about 90 microns are melted using a D.C. plasma torch. A mixture of argon and hydrogen is used for the palsma gas: argon flow rate—about 20 l/min, and hydrogen flow rate—about 1.5 l/min. The plasma gun power is about 25 KW. A 1.75 mm diameter injection port at the nozzle exit is used for injecting the powder agglomerates into the plasma jet. Argon at a flow rate of about 1.5 l/min. is used as the carrier gas. The composite powder is then collected at the chamber bottom and examined using optical and scanning electron microscopes. Scanning electron photographs of the starting agglomerates and the final product after plasma melting are shown in FIGS. 1 and 2 respectively. FIG. 2 shows the spherical shape of the resulting composite particles. The cross sectional microstructure of the resulting aluminum-titanium diboride composite powder is shown in FIG. 3. The titanium diboride particles dispersed in the aluminum alloy matrix can be seen.

EXAMPLE 2

Figure 4:
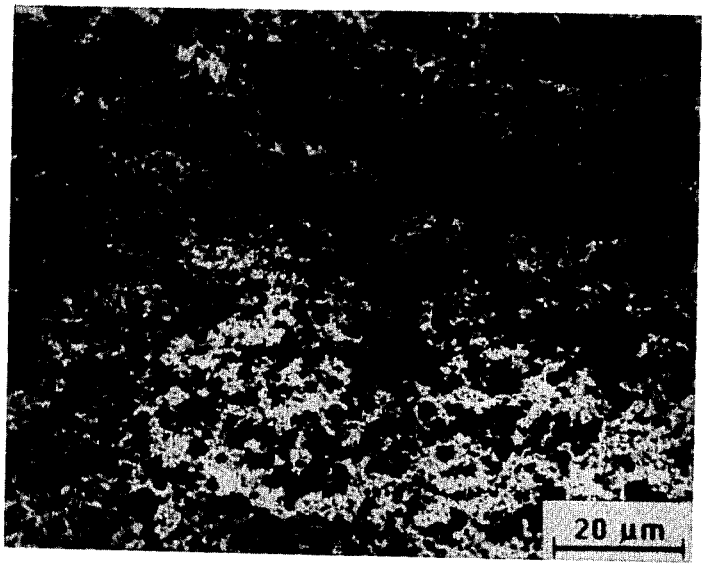
FIG. 4 is a cross-sectional micrograph of the deposit made by impacting the composite material onto a substrate while the metal matrix is still in a molten stage.

In a manner similar to that given in Example 1 2124Al-$TiB_2$ agglomerates are injected into a DC plasma jet. Agglomerate sizes and plasma gun operating conditions are the same as in Example 1. However, the particles are deposited onto a substrate rather than being allowed to resolidify in flight. Cross sectional micrographs of the resulting deposit on the substrate are shown in FIG. 4 in which the titanium diboride dispersed in the aluminum alloy matrix can be seen.

While there has been shown and described what are at present considered the preferred embodiment of the invention, it will be obvious to those skilled in the art that various changes and modifications may be made therein without departing from the scope of the invention as defined by the appended claims.

What is claimed is:

1. A process for producing composite powder particles consisting essentially of a matrix phase and a reinforcement phase, said process comprising:

(a) entraining agglomerated particles in a carrier gas, said agglomerated particles consisting essentially particles of titanium diboride and particles of a metal selected from the group consisting of aluminum and aluminum based alloys;

(b) feeding said agglomerated particles through a high temperature zone having a temperature sufficient to allow said metal particles to melt, coalesce together, and encapsulate said titanium diboride particles; and (c) resolidifying said metal to form said composite powder particles wherein said matrix phase consists essentially of said metal and said reinforcement phase consists essentially of said titanium diboride particles.

2. A process of claim 1 wherein said high temperature zone is a plasma.

3. A process of claim 1 wherein prior to being entrained in said carrier gas, said agglomerated powders are dewaxed, sintered, and classified.

4. A process of claim 1 wherein said metal is resolidifed by allowing the high temperature treated particles to pass out of said high temperature zone into a cooler zone having a temperature below the solidification temperature of said metal.

5. A process of claim 4 wherein said composite particles have a particle size of from about 25 to about 200 microns in diameter and wherein the particle size of said titanium diboride particles of said reinforcement phase is less than about 20 microns in diameter.

6. A process for producing a composite material consisting essentially of a matrix phase and a reinforcement phase, said process comprising:

(a) entraining agglomerated particles in a carrier gas, said agglomerated particles consisting essentially of titanium diboride particles and particles of a metal selected from the group consisting of aluminum and aluminum based alloys;

(b) feeding said agglomerated particles through a high temperature zone having a temperature sufficient to allow said metal particles to metl, coalesce together, and encapsulate said titanium diboride particles; and (c) resolidifying said metal to form said composite material wherein said matrix phase consists essentially of said metal and said reinforcement phase consists essentially of said titanium diboride said resolidifying being done by impacting the resulting high temperature treated particles against a surface having a temperature below the solidification temperature of said metal.

7. A process of claim 6 wherein said high temperature zone is a plasma.

8. A process of claim 6 wherein prior to being entrained in said carrier gas, said agglomerated powders are dewaxed, sintered, and classified.

* * * * *

UNITED STATES PATENT AND TRADEMARK OFFICE

CERTIFICATE OF CORRECTION

PATENT NO. : 4,690,796

DATED : 9/01/87

INVENTOR(S) : Muktesh Paliwal, Walter A.Johnson,John E. Miller

It is certified that error appears in the above-identified patent and that said Letters Patent are hereby corrected as shown below:

On the Title Page, Item [19] should read -- Paliwal et al. --

Item [75] Inventors: should read -- Muktesh Paliwal, Sayre; Walter A. Johnson, Towanda and John E. Miller, Monroeton, all of Pa. --

Signed and Sealed this

Fifth Day of April, 1988

*Attest:*

DONALD J. QUIGG

*Attesting Officer*

*Commissioner of Patents and Trademarks*